US005700302A

United States Patent [19]

Stoetzel et al.

[11] Patent Number: 5,700,302

[45] Date of Patent: Dec. 23, 1997

[54] RADIATION CURABLE ABRASIVE ARTICLE WITH TIE COAT AND METHOD

[75] Inventors: William L. Stoetzel, Lakeland; Scott R. Culler, Burnsville, both of Minn.

[73] Assignee: Minnesota Mining and Manufacturing Company, St. Paul, Minn.

[21] Appl. No.: 616,544

[22] Filed: Mar. 15, 1996

[51] Int. Cl.[6] ..... B24D 3/34

[52] U.S. Cl. ..... 51/295; 51/298

[58] Field of Search ..... 51/293, 295, 298

[56] References Cited

U.S. PATENT DOCUMENTS

| | | | |
|---|---|---|---|
| 4,047,903 | 9/1977 | Hesse et al. | 51/298 R |
| 4,163,647 | 8/1979 | Swiatek | 51/295 |
| 4,311,489 | 1/1982 | Kressner | 51/298 |
| 4,457,766 | 7/1984 | Caul | 51/298 |
| 4,474,585 | 10/1984 | Gruber | 51/298 |
| 4,547,204 | 10/1985 | Caul | 51/298 |
| 4,588,419 | 5/1986 | Caul et al. | 51/295 |
| 4,652,274 | 3/1987 | Boettcher et al. | 51/298 |
| 4,652,275 | 3/1987 | Bloecher et al. | 51/298 |
| 4,751,138 | 6/1988 | Tumey et al. | 428/323 |
| 4,799,939 | 1/1989 | Bloecher et al. | 51/293 |
| 4,903,440 | 2/1990 | Larson et al. | 51/298 |
| 4,927,431 | 5/1990 | Buchanan et al. | 51/298 |
| 4,985,340 | 1/1991 | Palazzotto et al. | 430/270 |
| 4,997,461 | 3/1991 | Markhoff-Matheny et al. | 51/295 |
| 5,009,675 | 4/1991 | Kunz et al. | 51/295 |
| 5,011,508 | 4/1991 | Wald et al. | 51/293 |
| 5,042,991 | 8/1991 | Kunz et al. | 51/295 |
| 5,055,113 | 10/1991 | Larson et al. | 51/298 |
| 5,061,294 | 10/1991 | Harmer et al. | 51/295 |
| 5,085,671 | 2/1992 | Martin et al. | 51/293 |
| 5,107,626 | 4/1992 | Mucci | 51/281 R |
| 5,137,542 | 8/1992 | Buchanan et al. | 51/295 |
| 5,152,917 | 10/1992 | Pieper et al. | 51/295 |
| 5,203,884 | 4/1993 | Buchanan et al. | 51/295 |
| 5,213,591 | 5/1993 | Celikkaya et al. | 51/293 |

(List continued on next page.)

FOREIGN PATENT DOCUMENTS

| | | | |
|---|---|---|---|
| 0 306 161 A2 | 11/1988 | European Pat. Off. . | |
| 0 306 162 A2 | 11/1988 | European Pat. Off. . | |
| 0 344 529 B1 | 6/1993 | European Pat. Off. . | |
| 0 552 698 A2 | 7/1993 | European Pat. Off. | B24D 3/28 |
| 0 620 083 A1 | 10/1994 | European Pat. Off. . | |
| 0 650 803 A1 | 5/1995 | European Pat. Off. . | |
| 0 654 323 A1 | 5/1995 | European Pat. Off. . | |
| WO 95/03156 | 2/1995 | WIPO . | |
| WO 95/07797 | 3/1995 | WIPO . | |

OTHER PUBLICATIONS

Eckberg et al., "UV Cure of Epoxysiloxanes," *Radiation Curing Polymer Science & Technology: vol. IV, Practical Aspects and Applications;* Fouassier et al., Eds.; Elsevier Applied Science: NY; Chapter 2, pp. 19–49 (1993).

Peeters, "Overview of Dual–Cure and Hybrid–Cure Systems in Radiation Curing", *Radiation Curing Polymer Science & Technology: vol. III, Polymer Mechanisms;* Fouassier et al., Eds.; Elsevier Applied Science: NY; Chapter 6, pp. 177–217 (1993).

*Primary Examiner*—Deborah Jones

*Attorney, Agent, or Firm*—Gary L. Griswold; Walter N. Kirn; Paul W. Busse

[57] ABSTRACT

A method of preparing an abrasive article, and the article produced therefrom is provided. The method includes the steps of: providing a backing having a first major surface; coating the first major surface of the backing with a tie coat precursor, wherein the tie coat precursor comprises a first radiation curable component; applying an abrasive slurry to the first major surface of the backing after coating the tie coat precursor thereon, wherein the abrasive slurry comprises a plurality of abrasive particles and a binder precursor, and further wherein the binder precursor comprises a second radiation curable component; at least partially curing the tie coat precursor; and at least partially curing the binder precursor to form an abrasive article, wherein the abrasive article comprises a backing, an abrasive layer, and a tie coat disposed between the backing and the abrasive layer. Preferably, the method provides a structured abrasive article.

30 Claims, 1 Drawing Sheet

U.S. PATENT DOCUMENTS

| | | | |
|---|---|---|---|
| 5,236,472 | 8/1993 | Kirk et al. | 51/298 |
| 5,304,223 | 4/1994 | Pieper et al. | 51/293 |
| 5,342,419 | 8/1994 | Hibbard | 51/308 |
| 5,344,688 | 9/1994 | Peterson et al. | 428/102 |
| 5,368,618 | 11/1994 | Masmar et al. | 51/295 |
| 5,368,619 | 11/1994 | Culler | 51/308 |
| 5,378,251 | 1/1995 | Culler et al. | 51/295 |
| 5,378,252 | 1/1995 | Follensbee | 51/298 |
| 5,391,210 | 2/1995 | Bilkadi et al. | 51/298 |
| 5,435,816 | 7/1995 | Spurgeon et al. | 51/295 |
| 5,453,312 | 9/1995 | Haas et al. | 428/143 |
| 5,456,975 | 10/1995 | Zador et al. | 428/241 |
| 5,527,368 | 6/1996 | Supkis et al. | 51/298 |

RADIATION CURABLE ABRASIVE ARTICLE WITH TIE COAT AND METHOD

FIELD OF THE INVENTION

This invention relates to radiation curable abrasive articles, particularly to structured abrasive articles, having a tie coat that enhances adhesion of the abrasive layer to the backing.

BACKGROUND OF THE INVENTION

Conventional coated abrasive articles comprise a backing having a plurality of abrasive particles bonded to at least one major surface thereof by means of one or more binders (e.g., make, size, and supersize coats). Slurry coated abrasive articles, such as structured abrasive articles comprise a backing bearing on at least one major surface thereof an abrasive layer comprising a plurality of abrasive particles dispersed in a binder. For a structured abrasive, the abrasive layer is in the form of a plurality of shaped abrasive composites bonded to a backing. The backing can be paper, polymeric film, vulcanized fiber, nonwoven substrates, cloth, and combinations thereof. Cloth backings are typically either stitchbonded or woven. These backings are often treated with treatment coat(s) to seal the cloth and to protect the individual fibers. The particular treatment coat chemistry and weight will modify the physical properties of the resulting backing.

Cloths made from synthetic fibers (e.g., polyester, rayon, or nylon) are popular abrasive backings due to their strength, tear resistance, and/or flexibility. However, it is sometimes difficult to adhere binders and treatment coats properly to cloth backings of these binders and treatment coats do not adhere properly, during abrading they will separate from the backing's fibers, which results in the release of abrasive particles. This phenomena is known in the abrasive art as shelling (i.e., the premature release of abrasive particles from the backing). In most cases, shelling is undesirable because it results in a loss of performance. What is desired by the abrasive industry is treating coats that will tenaciously adhere to fabrics. Besides the necessary adhesion between the treating coat and the yarns, the treating coat must also have adhesion to the binder in the abrasive layer. If there is poor adhesion between the treating coat and the abrasive binder, this can also lead to shelling.

For many years, conventional cloth backed coated abrasive articles utilized one or more treatment coats consisting of animal glues, starches, latices, thermally curable resins such as phenolic-based treatment coats or phenolic/latex treatment coats, and thermally cured phenolic-based binders in the abrasive coating. These combinations result in generally good adhesion between the treatment coat(s) and the fibers in the cloth backing and between the abrasive binder and the treatment coat(s). In recent years, some coated abrasive articles, particularly structured abrasive articles as disclosed in U.S. Pat. Nos. 5,152,917 (Pieper et al.) and 5,435,816 (Spurgeon et al.), have begun employing radiation cured binder systems, such as acrylate-based binders, in the abrasive layer instead of the phenolic-based binders. For some applications, the adhesion between conventional backing treatment coats, e.g., saturant coats, presize coats, and the like, and these new radiation cured binders is not as strong as desired, sometimes resulting in shelling, depending on the particular abrading application. This is true particularly if a continuous manufacturing process is used for making the abrasive article and relatively high processing speeds are used. Thus, what is needed is a system by which radiation cured binders, such as acrylate-based binders, can be used on treated cloth backings and produced in a continuous manufacturing process using relatively high processing speeds, with good adhesion.

SUMMARY OF THE INVENTION

The present invention provides a method of preparing an abrasive article, the method comprising: providing a backing having a first major surface; coating the first major surface of the backing with a tie coat precursor, wherein the tie coat precursor comprises a first radiation curable component; applying an abrasive slurry to the first major surface of the backing after coating the tie coat precursor thereon, wherein the abrasive slurry comprises a plurality of abrasive particles and a binder precursor, and further wherein the binder precursor comprises a second radiation curable component; at least partially curing the tie coat precursor; and at least partially curing the binder precursor to form an abrasive article, wherein the abrasive article comprises a backing, an abrasive layer, and a tie coat disposed between the backing and the abrasive layer. Preferably, the curing steps are carried out using radiation energy.

The step of at least partially curing the tie coat precursor can occur prior to the step of applying an abrasive slurry. Alternatively, the steps of at least partially curing the tie coat precursor and at least partially curing the binder precursor contained in the abrasive slurry occur substantially simultaneously (i.e., during the same curing stage of the process). Thus, when the abrasive slurry is applied to the first major surface of the backing, the tie coat precursor can be uncured, at least partially cured, or substantially cured. The phrase "tie-coated backing" is therefore used herein to refer to the backing when the abrasive slurry is coated thereon, and encompasses the embodiments wherein the backing is coated with an uncured tie coat precursor, a partially cured tie coat precursor, or a substantially cured tie coat.

Preferably, the tie coat precursor and binder precursor include acrylate-functional compounds. More preferably, they each include an acrylate monomer and an isocyanurate derivative having at least one pendant acrylate group. In particularly preferred embodiments, the tie coat precursor has the same composition as the binder precursor used in the abrasive slurry.

The present invention also provides a method of preparing an abrasive article, the method comprising: providing a treated cloth backing having a first major surface; coating the first major surface of the treated cloth backing with a tie coat precursor, wherein the tie coat precursor comprises a first radiation curable component; providing a radiation energy transmissive production tool having a contacting surface; applying an abrasive slurry onto the contacting surface of the production tool, wherein the abrasive slurry comprises a plurality of abrasive particles and a binder precursor, and further wherein the binder precursor comprises a second radiation curable component; causing the abrasive slurry on the contacting surface of the production tool to come into contact with the first major surface of the backing after coating the tie coat precursor thereon; at least partially curing the tie coat precursor; transmitting radiation energy through the production tool to at least partially cure the binder precursor to form a shaped, handleable structure; and separating the shaped, handleable structure from the production tool to form an abrasive article, wherein the abrasive article comprises a treated cloth backing, an abrasive layer, and a tie coat disposed between the treated cloth backing and the abrasive layer. As used herein, a shaped, handleable structure refers to the abrasive slurry when the binder precursor contained therein is at least partially cured, such that it is solidified sufficiently to be removed from the production tool without substantially losing the topographical pattern imparted by the production tool.

Also provided is an abrasive article comprising: a cloth backing having a first major surface; a radiation cured tie coat on the first major surface of the backing; and an abrasive layer on the radiation cured tie coat, wherein the abrasive layer comprises a plurality of abrasive particles dispersed in a radiation cured binder. Preferably, this article is a structured abrasive article.

DETAILED DESCRIPTION

Figure 1:
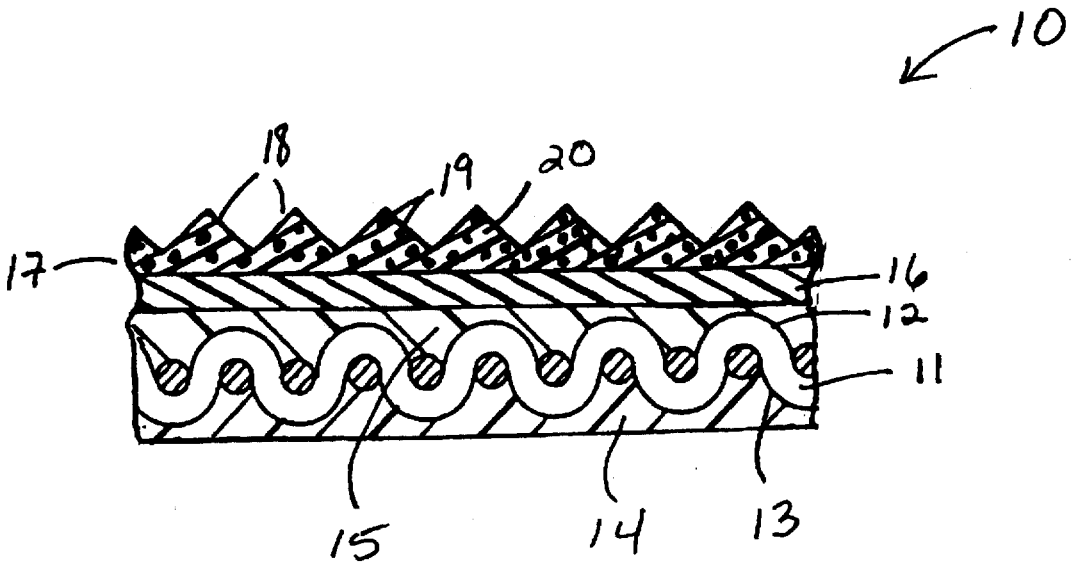
FIG. 1 is a cross-section of an abrasive article of the present invention.

The present invention provides a method of preparing an abrasive article having improved adhesion of an abrasive layer to a backing, preferably a cloth backing, and more preferably a treated cloth backing. The method is preferably carried out as a continuous process, and is particularly advantageous at relatively high run speeds. The method involves coating the backing with a tie coat precursor, applying an abrasive slurry comprising abrasive particles and a binder precursor to this tie-coated backing, at least partially curing the tie coat precursor, and at least partially curing the binder precursor to form an abrasive article. The tie coat precursor can be at least partially cured prior to the application of the abrasive slurry, or it can be at least partially cured substantially simultaneously with the binder precursor. The tie coat precursor includes a radiation curable component, as does the binder precursor used in the abrasive slurry, which may be the same or different. Preferably, the tie coat precursor has the same composition as the binder precursor used in the abrasive slurry.

The tie coat is particularly advantageous when used on a conventionally treated cloth backing, although it can be used on an untreated cloth backing or other backings, such as paper, polymeric film, etc. It provides greater adhesion of the abrasive layer to the backing, particularly to conventionally treated cloth backings, and allows for faster processing times in a continuous manufacturing process.

Typically, slurry coated abrasive articles, such as structured abrasive articles as disclosed in U.S. Pat. Nos. 5,152,917 (Pieper et al.) and 5,435,816 (Spurgeon et al.), are made using a continuous manufacturing process. They utilize radiation curable binder systems, such as acrylate-based binder precursors, in the abrasive slurry, that are typically cured with radiation energy during the continuous process. The speed at which this process is run, however, can be limited by the level of adhesion of the cured abrasive slurry (i.e., the abrasive layer) to the backing that can be obtained. Typically, speeds of less than 15.5 meters/minute are used to ensure adequate adhesion of the abrasive slurry to the backing. At speeds higher than this, however, adhesion of the abrasive slurry tends to diminish, which can be undesirable for certain applications.

The use of a tie coat prepared from a radiation curable system provides significant improvement in adhesion of the abrasive layer to the backing, particularly at abrasive-making line speeds of at least about 25 meters/minute, preferably at line speeds of at least about 50 meters/minute, more preferably at least about 75 meters/minute, and even at line speeds as high as about 100 meters/minute, for at least partial cure of the binder precursor in the abrasive slurry and optionally the tie coat precursor. As used herein, "line speed" refers to the rate at which the backing travels through the coating process, which includes applying the abrasive slurry to the backing and at least partially curing the binder precursor of the abrasive slurry. The coating process to which this "line speed" refers may include applying the tie coat precursor and at least partially curing the tie coat precursor. That is, although the tie coat precursor can be applied to the backing and at least partially cured during the process in which the abrasive slurry is applied, these steps can be carried out in a previous coating process and the tie-coated backing stored prior to application of the abrasive slurry.

The abrasive articles produced by this method are prepared from an abrasive slurry coated on a backing to provide a generally continuous layer of abrasive particles dispersed in a binder. This is referred to herein as a coated abrasive article, and more specifically as a slurry coated abrasive article. To enhance adhesion of the abrasive layer to the backing, a tie coat is disposed between the backing, optionally coated with one or more conventional treatment coat(s), and the abrasive layer. The abrasive layer may have a smooth, textured, embossed, structured, etc., surface.

One particularly preferred method of making such a slurry coated abrasive article includes placing the abrasive slurry into a mold to form a plurality of individual shaped abrasive precursor composites, which is then brought into contact with the backing, and subsequently at least partially cured to provide a shaped, handleable structure such that the tooling can be removed. The resultant product is referred to herein as a structured abrasive article comprising shaped abrasive composites. The individual shaped abrasive composites are three-dimensional with work surfaces that contact the workpiece during grinding.

It is preferred that these shaped abrasive composites be "precisely" shaped. This means that the shape of the composites is defined by relatively smooth surfaced sides that are bounded and joined by well-defined edges having distinct edge lengths with distinct endpoints defined by the intersections of the various sides. The terms "bounded" or "boundary" means the exposed surfaces and edges of each composite that delimit and define the actual three-dimensional shape of each abrasive composite. These boundaries are readily visible and discernible when a cross-section of an abrasive article is viewed under a scanning electron microscope. These boundaries separate and distinguish one abrasive composite from another even if the composites abut each other along a common border at their bases. By comparison, in an abrasive composite that does not have a precise shape, the boundaries and edges are not well defined, e.g., where the abrasive composite sags before completion of its curing. In some instances, it is preferred that these abrasive composites be arranged on the backing in a predetermined pattern or array.

Referring to FIG. 1, structured abrasive article 10 includes backing 11 having front surface 12 and back surface 13. The backing can further include optional backfill coat 14 that coats the backing, and optional presize coat 15 applied to the front surface 12 of the backing. To enhance adhesion of structured abrasive layer 17 to backing 11, tie coat 16 is disposed between backing 11 (optionally coated with either backfill coat 14, presize coat 15, or both) and structured abrasive layer 17. Structured abrasive layer 17 includes abrasive composites 18 comprising a plurality of abrasive particles 19 dispersed in binder 20.

Backing

The backing used in the abrasive articles of this invention has a from and back surface (i.e., a first and a second major surface) and can be any suitable material typically used for conventional abrasive backings. Examples of such materials include primed and unprimed polymeric film, cloth, paper, vulcanized fiber, nonwoven webs, and combinations thereof. The backing may also contain a treatment or treatments to seal the backing and/or modify the physical properties of the backing. These treatments are well known in the art, and are discussed in greater detail below.

The preferred backing of the invention is a cloth backing. The cloth is composed of yarns in the warp direction, i.e., the machine direction and yarns in the fill direction, i.e., the cross direction. The cloth backing can be a woven backing, a stitchbonded backing, or a weft insertion backing. Examples of woven constructions include sateen weaves of four over one weave of the warp yarns over the fill yarns; twill weaves of three over one weave; plain weaves of one over one weave; and drill weaves of two over one weave. In a stitchbonded fabric or weft insertion backing, the warp and fill yarns are not interwoven, but are oriented in two distinct directions from one another. The warp yarns are laid on top of the fill yarns and secured to another by a stitch yarn or by an adhesive.

The yarns in the cloth backing can be natural, synthetic, or combinations thereof. The yarns can be twisted or texturized. Examples of natural yarns include cellulosics such as cotton, hemp, kapok, flax, sisal, jute, manila and combinations thereof. Examples of synthetic yarns include polyester yarns, polypropylene yarns, glass yarns, polyvinyl alcohol yarns, polyimide yarns, aromatic polyarnide yarns, regenerated cellulose yarns such as rayon yarns, nylon yarns, polyethylene yarns, and combinations thereof. The preferred yarns of this invention are polyester yarns, nylon yarns, a mixture of polyester and cotton, cellulosic yarns, and aromatic polyarnide yarns.

Polyester yarns are formed from a long chain polymer made from the reaction of an ester of dihydric alcohol and terephthalic acid. Preferably, this polymer is a linear polymer of poly(ethylene terephthalate). There are three main types of polyester yarns: ting spun; open end; and filament. A ring spun yarn is made by continuously drafting a polyester yarn, twisting the yarn and winding the yarn on a bobbin. An open end yarn is made directly from a sliver or roving. A series of polyester rovings are opened and then all of the rovings are continuously brought together in a spinning apparatus to form a continuous yarn. A filament yarn is a long continuous fiber; a filament yarn typically has a very low or non-existent twist to the polyester fiber.

The denier of the fibers should be less than about 2000, preferably about 100–1500. The yarn size should be within a range of about 1500–12,000 meters/kilogram. For a coated abrasive cloth backing, the weight of the greige cloth, i.e., the untreated cloth or raw cloth, will be within a range of about 0.1–1 kg/m$^2$, preferably within a range of about 0.1–0.75 kg/m$^2$. Untreated "J" weight cloth typically has a weight of about 130–195 g/m$^2$, "X" weight cloth typically has a weight of about 200–245 g/m$^2$, and "Y" weight cloth typically has a weight of about 270–330 g/m$^2$. The cloth backing should also have a high surface area.

Coated abrasive cloth backings can be dyed, stretched, desized, or heat set. Additionally, the yarns in the cloth backing can contain primers, dyes, pigments, or wetting agents. The cloth backings can also have a variety of treatment coats, such as a saturant coat, presize coat, backsize coat, subsize coat, backfill coat, frontfill coat, and the like. As used herein, a "treated" cloth backing refers to a cloth backing that has at least one such treatment coat. This does not include cloth that does not have a residual coating thereon, such as cloth that has been desized or heat set.

Preferably, the cloth backing includes at least one of these treatment coats. The purpose of these treatment coats is to seal the backing and/or protect the yarns or fibers in the backing, reduce stretch, improve heat resistance, improve moisture resistance, tailor flexibility, and/or improve adhesion. The addition of one or more of these treatment coats may additionally result in a "smoother" surface on either the front or back side of the backing.

After any one of the treatment coats is applied to the cloth backing, the resultant treated cloth backing can be heat treated or calendered. The heat treatment can be carried out in a tenter frame which is in an oven. Additionally the backing can be processed through heated hot cans. The calendering step will remove surface roughness and typically increase the surface smoothness.

Conventional cloth treatments, whether they be applied as saturant coats, presize coats, backsize coats, backfill coats, frontfill coats, etc., include various starches, gums, dextrins, animal glues, urea-formaldehyde resins, poly(vinyl alcohol) and poly(vinyl acetate) resins and latices, ethyl cellulose, nitrile latices, styrene/butadiene latices, vinyl and rubber latices, epoxies, phenolic resins, acrylate resins, acrylic latices, urethane resins, vinyl ether-functional resins, and combinations thereof. Preferred cloth treatments for use with the radiation curable materials used in the tie coat precursor of the present invention include poly(vinyl acetate) latices, nitrile latices, stryene/butadiene tatices, acrylic latices, phenolic resins, and combinations thereof. Particularly preferred cloth treatments for use with the radiation curable materials used in the tie coat precursor of the present invention include acrylic latices, phenolic resins, and combinations thereof. Suitable acrylic latices are those forming films having the following physical properties: glass transition temperatures of about −50° C. to about +40° C., preferably about −5° C. to about +35° C.; tensile strength of at greater than about 1.38 MPa, preferably greater than about 6.89 MPa; and elongation of greater than about 10%, preferably less than about 5000%, and more preferably about 250–1000%. Such acrylic latices are commercially available from B.F. Goodrich Co., Cleveland, Ohio, Ato-Haas North America, Inc., Bristol, PA, Air Products and Chemicals, Inc., Reichhold Chemical Co. Suitable phenolic resins are water miscible and form continuous homogenous films with the selected acrylic latex. Such phenolic resins are commercially available from Occidental Chemical Corp., Dallas, Tex., Georgia Pacific Resins, Inc., Columbus, Ohio, Ashland Chemical Co., Columbus, Ohio, Monsanto, St. Louis, Mo., and Bakelite, Letmathe, Germany.

Tie Coat and Binder Systems

The binder system used in the abrasive layer in the abrasive articles of the invention is formed from a binder precursor. The tie coat is formed from a tie coat precursor. Both comprise a resinous adhesive in an uncured and flowable state that is capable of solidifying. Both can include the same components, or they can be different, although they both include the following components. The solidification can be achieved by curing (i.e., polymerizing and/or crossing) or by drying (e.g., driving off a liquid) and curing. The binder and tie coat precursors can be organic solvent-borne, water-borne, or 100% solids (i.e., a substantially solvent-free) compositions. That is, the binder and tie coat may be formed from a 100% solids formulation or they may be coated out of a solvent (e.g., a ketone, tetrahydrofuran, or water) with subsequent drying and curing. If a solvent is used, it is one that does not react with the other components of the precursors, but can be driven off by heat, for example, although complete elimination is not necessarily required. Preferably, both the lie coat precursor and the binder precursor are 100% solids formulations that are substantially solvent-free (i.e., contain less than about 1 wt-% solvent).

The binder and tie mat precursors are capable of irreversibly forming a cured oligomeric/polymeric material and are often referred to as "thermosetting" precursors. The term "thermosetting" precursor is used herein to refer to reactive systems that irreversibly cure upon the application of heat and/or other sources of energy, such as E-beam, ultraviolet, visible, etc., or with time upon the addition of a chemical catalyst, moisture, or the like. The term "reactive" means that the components of the binder and tie coat precursors react with each other (or self react) either by polymerizing, crosslinking, or both. These components are often referred to as resins. As used herein, the term "resin" refers to polydisperse systems containing monomers, oligomers, polymers, or combinations thereof.

Materials suitable for forming the abrasive binder and the tie coat are precursors comprising reactive components (i.e., components capable of being crosslinked and/or polymerized) that are curable using radiation. These are referred to herein as radiation curable materials. As used herein, "radiation curable" refers to curing mechanisms that involve polymerization and/or crosslinking of resin systems upon exposure to ultraviolet radiation, visible radiation, electron beam radiation, or combinations thereof, optionally with the appropriate catalyst or initiator. Typically, there are two types of radiation cure mechanisms that occur—free radical curing and cationic curing. These usually involve one stage curing or one type of curing mechanism. Suitable materials for use in the abrasive articles of the present invention are free radical curable materials; however, mixtures of free radical and cationic materials may also be cured to impart desired properties from both systems. Also possible are dual-cure and hybrid-cure systems, as discussed below, as long as the system includes a material capable of radiation curing.

In cationic systems, cationic photoinitiators react upon exposure to ultraviolet/visible light to decompose to yield an acid catalyst (e.g., a protonic acid or Lewis acid). The acid catalyst propagates a crosslinking reaction via an ionic mechanism. Epoxies, particularly cycloaliphatic epoxies, are the most common resins used in cationic curing, although aromatic epoxies and vinyl ether based oligomers can also be used. Furthermore, polyols can be used in cationic curing with epoxies as chain-transfer agents and flexibilizers. Also, epoxysiloxanes as disclosed in Eckberg et al., "UV Cure of Epoxysiloxanes," *Radiation Curing in Polymer Science and Technology: Volume IV, Practical Aspects and Applications*, Fouassier and Rabek, eds., Elsevier Applied Science, NY, Chapter 2, 19–49 (1993) can be cured using a cationic photoinitiator. The cationic photoinitiators include salts of onium cations, such as arylsulfonium salts, as well as organometallic salts such as iron arene systems. Examples of cationic photoinitiators are disclosed in U.S. Pat. Nos. 4,751,138 (Tumey et al.) and 4,985,340 (Palazzotti), and European Patent Application Nos. 306,161 and 306,162.

In free radical systems, radiation provides very fast and controlled generation of highly reactive species that initiate polymerization of unsaturated materials. Examples of free radical curable materials include, but are not limited to, acrylate resins, aminoplast derivatives having pendant alpha, beta-unsaturated carbonyl groups, isocyanurate derivatives having at least one pendant acrylate group, isocyanate derivatives having at least one pendant acrylate group, unsaturated polyesters (e.g., the condensation products of organic diacids and glycols), and other ethylenically unsaturated compounds, and mixtures or combinations thereof. These free radical curable systems can be cured using radiation energy, although they can be cured using thermal energy, as long as there is a source of free radicals in the system (e.g., peroxide or azo compounds). Thus, the phrase "radiation curable," and more particularly the phrase "free radical curable," include within their scope systems that also can be cured using thermal energy and that involve a free radical curing mechanism. In contrast, the phrase "radiation cured" refers to systems that have been cured by exposure to radiation energy.

Suitable acrylate resins for use in the present invention include, but are not limited to, monofunctional and multifunctional acrylate monomers, as well as acrylated urethanes (i.e., urethane acrylates), acrylated epoxies (i.e., epoxy acrylates), acrylated polyesters (i.e., polyester acrylates), acrylated acrylics, and acrylated polyethers (i.e., polyether acrylates). As used herein, the terms "acrylate" and "acrylate-functional" compound includes both acrylates and methacrylates, whether they be monomers, oligomers, or polymers.

Examples of suitable monofunctional acrylate monomers include, but are not limited to, ethyl acrylate, ethyl methacrylate, ethyl acrylate, methyl methacrylate, isooctyl acrylate, oxethylated phenol acrylate, isobornyl acrylate, 2-ethylhexyl acrylate, vinyl pyrrolidone, 2-phenoxyethyl acrylate, 2-(ethoxyethoxy)ethyl acrylate, ethylene glycol methacrylate, tetrahydroxy furfuryl acrylate (THF acrylate), caprolactone acrylate, and methoxy tripropylene glycol monoacrylate. Examples of suitable multifunctional acrylate monomers include, but are not limited to, triethylene glycol diacrylate, pentaerythritol triacrylate, trimethylolpropane triacrylate, pentaerythritol trimethacrylate, glycerol triacrylate, trimethylolpropane trimethacrylate, trimethylolpropane triacrylate, 1,6-hexanediol diacrylate, 1,4-butanediol diacrylate, tetramethylene glycol diacrylate, tripropylene glycol diacrylate, ethylene glycol diacrylate, ethylene glycol dimethacrylate, polyethylene glycol diacrylate, pentaerythritol tetraacrylate, pentaerythritol tetramethacrylate, and 1,6-hexane diacrylate. Such compounds are available under the trade designations EBECRYL from UCB Radcure Inc., Smyrna, Ga., PHOTOMER from Henkel Corp., Hoboken, N.J., and SARTOMER from Sartomer Co., West Chester, Pa. Preferably, the tie coat and binder precursor compositions include a multifunctional acrylate monomer.

Acrylated urethanes are diacrylate esters of hydroxy terminated isocyanate extended polyesters or polyethers. They can be aliphatic or aromatic, although acrylated aliphatic urethanes are preferred because they are less susceptible to weathering. Examples of commercially available acrylated urethanes include those known by the trade designations PHOTOMER (e.g., PHOTOMER 6010) from Henkel Corp., Hoboken, N.J.; EBECRYL 220 (hexafunctional aromatic urethane acrylate of molecular weight 1000), EBECRYL 284 (aliphatic urethane diacrylate of 1200 molecular weight diluted with 1,6-hexanediol diacrylate), EBECRYL 4827 (aromatic urethane diacrylate of 1600 molecular weight), EBECRYL 4830 (aliphatic urethane diacrylate of 1200 molecular weight diluted with tetraethylene glycol diacrylate), EBECRYL 6602 (trifunctional aromatic urethane acrylate of 1300 molecular weight diluted with trimethylolpropane ethoxy triacrylate), and EBECRYL 8402 (aliphatic urethane diacrylate of 1000 molecular weight) from UCB Radcure Inc., Smyrna, Ga.; SARTOMER (e.g., SARTOMER 9635, 9645, 9655, 963-B80, 966-A80, etc.) from Sartomer Co., West Chester, Pa.; and UVITHANE (e.g., UVITHANE 782) from Morton International, Chicago, Ill.

Acrylated epoxies are diacrylate esters of epoxy resins, such as the diacrylate esters of bisphenol A epoxy resin. Examples of commercially available acrylated epoxies include those known by the trade designations EBECRYL 600 (bisphenol A epoxy diacrylate of 525 molecular weight), EBECRYL 629 (epoxy novolac acrylate of 550 molecular weight), and EBECRYL 860 (epoxidized soya oil acrylate of 1200 molecular weight) from UCB Radcure Inc., Smyrna, Ga.; and PHOTOMER 3016 bisphenol A epoxy diacrylate), PHOTOMER 3038 (epoxy acrylate/tripropylene glycol diacrylate blend), PHOTOMER 3071 (modified bisphenol A acrylate), etc. from Henkel Corp., Hoboken, N.J.

Acrylated polyesters are the reaction products of acrylic acid with a dibasic acid/aliphatic/diol-based polyester. Examples of commercially available acrylated polyesters include those known by the trade designations PHOTOMER 5007 (hexafunctional acrylate of 2000 molecular weight), PHOTOMER 5018 (tetrafunctional acrylate of 1000 molecular weight), and other acrylated polyesters in the PHOTOMER 5000 series from Henkel Corp., Hoboken, N.J.; and EBECRYL 80 (tetrafunctional modified polyester acrylate of 1000 molecular weight), EBECRYL 450 (fatty acid modified polyester hexaacrylate), and EBECRYL 830 (hexafunctional polyester acrylate of 1500 molecular weight) from UCB Radcure Inc., Smyrna, Ga.

Acrylated acrylics are acrylic oligomers or polymers that have reactive pendant or terminal acrylic acid groups capable of forming free radicals for subsequent reaction. Examples of commercially available acrylated acrylics include those known by the trade designations EBECRYL 745, 754, 767, 1701, and 1755 from UCB Radcure Inc., Smyrna, Ga.

Isocyanurate derivatives having at least one pendant acrylate group and isocyanate derivatives having at least one pendant acrylate group are further described in U.S. Pat. No. 4,652,274 (Boetcher et al.). Preferred binder precursors and tie coat precursors of the present invention include an isocyanurate derivative having at least one pendant acrylate group. The preferred isocyanurate is a triacrylate of tris (hydroxy ethyl) isocyanurate.

The aminoplast resins have at least one pendant alpha, beta-unsaturated carbonyl group per molecule or oligomer. These unsaturated carbonyl groups can be acrylate, methacrylate, or acrylamide type groups. Examples of resins with acrylamide groups include N-(hydroxymethyl)-acrylamide, N,N'-oxydimethylenebisacrylamide, ortho- and para-acrylamidomethylated phenol, acrylamidomethylated phenolic novolac, glycoluril acrylamide, acrylamidomethylated phenol, and combinations thereof. These materials are further described in U.S. Pat. Nos. 4,903,440 (Larson et al.), 5,055,113 (Larson et al.), and 5,236,472 (Kirk et al.).

Other suitable ethylenically unsaturated resins include monomeric, oligomeric, and polymeric compounds, typically containing ester groups, acrylate groups, and amide groups. Such ethylenically unsaturated compounds preferably have a molecular weight of less than about 4,000. They are preferably esters made from the reaction of compounds containing aliphatic monohydroxy groups or aliphatic polyhydroxy groups and unsaturated carboxylic acids, such as acrylic acid, methacrylic acid, itaconic acid, maleic acid, and the like. Representative examples of acrylates are listed above. Other ethylenically unsaturated resins include monoallyl, polyallyl, and polymethallyl esters and amides of carboxylic acids, such as diallyl phthalate, diallyl adipate, N,N-diallyladipamide as well as, styrene, divinylbenzene, vinyl toluene. Still others include tris(2-acryloyl-oxyethyl) -isocyanurate, 1,3,5-tri(2-methyaeryloxyethyl)-s-triazine, acrylamide, methylacrylamide, N-methylacrylamide, N,N-dimethylacrylamide, N-vinylpyrrolidone, and N-vinylpiperidone.

In dual-cure resin systems, the polymerization or crosslinking occur in two separate stages, via either the same or different reaction mechanisms. In hybrid-cure resin systems, two mechanisms of polymerization or crosslinking occur at the same time on exposure to ultraviolet/visible or E-beam radiation. The chemical curing mechanisms that can occur in these systems include, but are not limited to, radical polymerization of acrylic double bonds, radical polymerization of unsaturated polyesters of styrene or other monomers, and cationic curing of vinyl ethers or epoxies. Thus, the dual-cure and hybrid-cure systems can combine radiation curing with thermal curing, or radiation curing with moisture curing, for example. A combination of E-beam curing with ultraviolet/visible curing is also possible. Combining curing mechanisms can be accomplished, for example, by mixing materials with two types of functionality on one structure or by mixing different materials having one type of functionality. Such systems are discussed in Peeters, "Overview of Dual-Cure and Hybrid-Cure Systems in Radiation Curing," *Radiation Caring in Polymer Science and Technology: Volume III, Polymer Mechanisms*, Fouassier and Rabek, eds., Elsevier Applied Science, N.Y., Chapter 6, 177–217 (1993).

Of the radiation curable materials, the acrylates are particularly preferred for use in the binder and tie coat precursors of the present invention. Examples of such materials include, but are not limited to, mono- or multi-functional acrylates (i.e., acrylates and methacrylates), acrylated epoxies, acrylated polyesters, acrylated aromatic or aliphatic urethanes, acrylated acrylics, acrylated silicones, etc., and combinations or blends thereof. These can be monomers or oligomers (i.e., moderately low molecular weight polymers typically containing 2–100 monomer units, and often 2–20 monomer units) of varying molecular weight (e.g., 100–2000 weight average molecular weight).

A photoinitiator is typically included in ultraviolet/visible curable precursors of the present invention. Illustrative examples of photopolymerization initiators (i.e., photoinitiators) include, but are not limited to, organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Specific examples include benzil, methyl o-benzoate, benzoin, benzoin ethyl ether, benzoin isopropyl ether, benzoin isobutyl ether, benzophenone/tertiary amine, acetophenones such as 2,2-diethoxyacetophenone, benzyl methyl ketal, 1-hydroxycyclohexylphenyl ketone, 2-hydroxy-2-methyl-1-phenylpropan-1-one, 1-(4-isopropylphenyl)-2-hydroxy-2-methylpropan-1-one, 2-benzyl-2-N,N-dimethylamino-1-(4-morpholinophenyl)-1-butanone, 2,4,6-trimethylbenzoyl-diphenylphosphine oxide, 2-methyl-1-4(methylthio), phenyl-2-morpholino-1-propanone, bis(2,6 -dimethoxybenzoyl)(2,4,4-trimethylpentyl)phosphine oxide, etc. Such photoinitiators include those available under the trade designations DAROCUR 4265 (50:50 blend of 2-hydroxy-2-methyl-1-phenylpropan-1-one and 2,4,6-trimethylbenzoyldiphenylphosphine oxide) and CGI1700 (25:75 blend of bis(2,6-dimethoxybezoyl)-2,4,4-trimethylpentylphosphine and 2-hydroxy-2-methyl-1-phenylpropan-1-one) available from Ciba-Geigy Corp., Ardsley, N.Y. The tie coat precursor and binder precursor include a sufficient mount of photoinitiator to provide the line speeds discussed above. Typically, this is within a range of about 0.01–5 wt-%, based on the total composition of the precursor.

Abrasive Particles

The abrasive particles typically have a particle size in a range of about 0.1–1500 micrometers, and preferably about 0.1–400 micrometers. It is preferred that the abrasive particles have a MOH's hardness of at least about 8, more preferably at least about 9. Examples of such abrasive particles include, but are not limited to, fused aluminum oxide which includes brown aluminum oxide, heat treated aluminum oxide and white aluminum oxide, green silicon carbide, silicon carbide, chromia, alumina zirconia, diamond, iron oxide, ceria, cubic boron nitride, garnet, sol-gel abrasive particles, and combinations thereof.

The term abrasive particles also encompasses agglomerates wherein single abrasive particles are bonded together. Abrasive agglomerates are further described in U.S. Pat. Nos. 4,311,489 (Kressner), 4,652,275 (Bloecher et al.), and 4,799,939 (Bloecher et al.), the disclosures of which are incorporated herein by reference.

Abrasive particles used in the abrasive articles and/or made according to the present invention can also include a surface coating. Surface coatings are known to improve the adhesion between the abrasive particles and the binder in abrasive articles. They may also improve the abrading properties of the articles. Such surface coatings are, for example, described in U.S. Pat. Nos. 5,011,508 (Wald et al.), 5,009,675 (Kunz et al.), 4,997,461 (Markhoff-Matheny et al.), 5,213,591 (Celikkaya et al.), 5,085,671 (Martin et al.), and 5,042,991 (Kunz et al.), the disclosures of which are incorporated by reference.

Additionally, the abrasive mires may contain a blend of the abrasive particles with diluent particles. These diluent parities can be selected from the group consisting of: (1) an inorganic particle (nonabrasive inorganic particle); (2) an organic particle; (3) a composite diluent particle containing a mixture of inorganic particles and a binder; (4) a composite diluent particle containing a mixture of organic particles and a binder. The nonabrasive inorganic particles typically include materials having a Moh's hardness of less than about 6. The nonabrasive inorganic particles can include grinding aids, fillers, and the like, which are described below. The particle size of these diluent particles can be within a range of about 0.01–1500 micrometers, typically about 1–1000 micrometers. The diluent particles may have the same particle size and particle size distribution as the abrasive particles, or they may be different.

Optional Additives for the Binder System

The binder precursor and/or tie coat precursor can further include additives, such as, for example, fillers, grinding aids, fibers, lubricants, wetting agents, thixotropic materials, surfactants, pigments, dyes, antistatic agents, coupling agents, plasticizers, suspending agents, and the like. The amounts of these materials are selected to provide the desired properties. The use of these can affect the erodability of the abrasive composite. In some instances, an additive is purposely added to make the abrasive composite more erodable, thereby expelling dulled abrasive particles and exposing new abrasive particles.

Fillers and grinding aids may be particulate materials. Examples of particulate materials that act as fillers include metal carbonates, silica, silicates, metal sulfates, metal oxides, and the like. Examples of materials that act as grinding aids include: halide salts such as sodium chloride, potassium chloride, sodium cryolite, and potassium tetrafluoroborate; metals such as tin, lead, bismuth, cobalt, antimony, iron, and titanium; organic halides such as polyvinyl chloride and tetrachloronaphthalene; sulfur and sulfur compounds; graphite; and the like. A grinding aid is a material that has a significant effect on the chemical and physical processes of abrading, which results in improved performance. In particular, it is believed in the art that the grinding aid will: (1) decrease the friction between the abrasive particles and the workpiece being abraded; (2) prevent the abrasive particle from "capping," (i.e., prevent metal particles from becoming welded to the tops of the abrasive particles; (3) decrease the interface temperature between the abrasive particles and the workpiece; or (4) decrease the grinding forces. In a coated abrasive article with a make, size, and supersize coat, a grinding aid is typically used in the size or supersize coat applied over the surface of the abrasive particles. Typically, if desired, a grinding aid is used in an amount of about 5–300 g/m$^2$ of abrasive article.

Examples of antistatic agents include graphite, carbon black, vanadium oxide, humectants and the like. These antistatic agents are disclosed in U.S. Pat. Nos. 5,0,51,294 (Harmer et al.), 5,137,542 (Buchanan et al.), and 5,203,884 (Buchanan et al.), the disclosures of which are incorporated herein after by reference.

A coupling agent can provide an association bridge between the binder precursor and the filler particles or abrasive particles. Examples of coupling agents include silanes, titanates, and zircoaluminates. The abrasive slurry preferably includes about 0.01–3% by weight coupling agent. There are various means to incorporate the coupling agent. For example, the coupling agent may be added directly to the binder precursor. Alternatively, the coupling agent may be applied to the surface of the filler particles. In still another means, the coupling agent is applied to the surface of the abrasive particles prior to being incorporated into the abrasive article.

Methods of Making the Abrasive Articles

The abrasive articles of the invention are prepared by coating the backing with the tie coat precursor at a coating weight of about 4–117 g/m$^2$, preferably about 12–63 g/m$^2$, and more preferably about 16–34 g/m$^2$. The tie coat precursor can be applied by a variety of methods, such as knife coating, die coating, gravure coating, squeeze roll coating, spray coating, curtain coating, and other methods that can uniformly apply at least a monomolecular layer to the substrate. The abrasive slurry can then be applied to this fie coated-backing by a variety of methods, such as roll coating, gravure coating, knife coating, spray coating, transfer coating, vacuum die coating, die coating, and the like, or the tie-coated backing can be brought into contact with the abrasive slurry in a mold having the inverse of the desired topography.

The tie coat precursor can be at least partially cured prior to application of the abrasive slurry. Alternatively, the tie coat precursor can be at least partially cured at the same time that the binder precursor of the abrasive slurry is at least partially cured. The term "partial cure" means that the resin is polymerized and/or crosslinked to such a state that the slurry does not flow from an inverted test tube. For structured abrasive articles, partial cure of the resin at the interface between the resin and the tooling is important to allow removal of the tooling. Partial cure is accomplished by adjusting the dosage and radiation, as is commonly done by one of skill in the art. If further cure is desired, the resin can then be further cured with time and/or exposure to another energy source, such as a thermal energy source.

Suitable energy sources for use in the curing steps of the invention include thermal energy, electron beam, ultraviolet light, visible light, or combinations thereof. Preferably, radiation energy is used, and more preferably UV/visible light is used. Electron beam radiation, which is also known as ionizing radiation, can be used at an energy level of about 0.1 Mrad to about 10 Mrad, and at an accelerating voltage level of about 75 Kev to about 5 mev, preferably at an accelerating voltage level of about 250 Kev to about 300 Kev. Ultraviolet radiation refers to nonparticulate radiation having a wavelength within the range of about 200 nanometers to about 400 nanometers. It is preferred that 118–236 watts/cm ultraviolet lights are used. Visible radiation refers to nonparticulate radiation having a wavelength within the range of about 400 nanometers to about 800 nanometers.

The rate of curing depends on the degree of cure desired, the thickness of the abrasive slurry and tie coat precursor layers (i.e., coating weights), as well as the compositions of these layers. Although some abrasive particles and/or optional additives may absorb the radiation energy to inhibit curing of the binder precursor and tie coat precursor, higher doses of radiation energy can be employed to the extent needed to compensate for such radiation absorbance. Significantly, however, the abrasive articles are sufficiently cured within seconds, and even fractions of a second. This is particularly unexpected because of the thickness of the abrasive slurry layer and tie coat precursor layer, which can be about 0.076 cm. Additionally, after the abrasive articles are cured by radiation energy, they can be post-cured by thermal energy. Generally, this does not provide advantage to the curing of the binder precursor or tie coat precursor, but can provide advantage for some conventional cloth treatment coats.

Preferred methods of making conventional structured abrasive articles are described in U.S. Pat. No. 5,435,816 (Spurgeon et al.). One method involves: (1) introducing the abrasive slurry (abrasive particles and binder precursor) onto a contacting surface of a production tool, wherein the production tool has a contacting surface with a specified topography or pattern; (2) introducing a tie-coated backing to the contacting surface of the production tool such that the slurry wets the front surface (i.e., the first major surface) of the tie-coated backing to form an intermediate article; (3) at least partially curing the binder precursor and fie coat precursor before the intermediate article departs from the contacting surface of the production tool to form a shaped, handleable structure; and (4) removing the shaped, handleable structure with the backing thereon (i.e., the structured abrasive article) from the production tool.

Another method involves: (1) introducing the abrasive slurry onto the tie coated backing such that the abrasive slurry wets the front side (i.e., the first major surface) of the backing to form an intermediate article; (2) introducing the intermediate article to the contacting surface of a production tool under a sufficient force to cause the abrasive slurry to assume the shape (i.e., the topography or pattern) of the contacting surface of the production tool; (3) at least partially curing the binder precursor and tie coat precursor before the intermediate article departs from the contacting surface of the production tool to form a shaped, handleable structure; and (4) removing the shaped, handleable structure with the backing thereon (i.e., the structured abrasive article) from the production tool. These methods can be batch processes or continuous processes, preferably, however, they are continuous processes. If a continuous process is used, the tie coat precursor can be applied and at least partially cured in line.

If the production tool is made from a transparent material (e.g., a polypropylene or polyethylene thermoplastic), then either visible or ultraviolet light can be transmitted through the production tool and into the abrasive slurry to cure the binder precursor. This is further described in U.S. Pat. No. 5,435,816 (Spurgeon et al.). Alternatively, if the abrasive backing is transparent to visible or ultraviolet light, visible or ultraviolet light can be transmitted through the abrasive backing. Preferably, the production tool is radiation transmissive and allows radiation energy, particularly ultraviolet/visible light, to be transmitted therethrough.

The resulting solidified abrasive slurry (i.e., the shaped, handleable structure or the abrasive composite) has the inverse pattern of the production tool. By at least partially curing or solidifying on the production tool, the abrasive composite has a precise and predetermined pattern. The binder can be further solidified or cured off the production tool.

A production tool having a plurality of precisely shaped cavities is used to make the structured abrasive article. These cavities are essentially the inverse shape of the abrasive composites and are responsible for generating the shape of the abrasive composites. The dimensions of the cavities are selected to provide the desired shape and dimensions of the abrasive composites.

The production tool can be a belt, a sheet, a continuous sheet or web, a coating roll such as a rotogravure roll, a sleeve mounted on a coating roll, or a die. The production tool can be composed of metal, (e.g., nickel), metal alloys, or plastic. The metal production tool can be fabricated by any conventional technique such as engraving, hobbing, electroforming etching, diamond turning, and the like. One preferred technique for a metal production tool is diamond ring. It is preferably a thermoplastic production tool made from polypropylene as disclosed in U.S. Pat. No. 5,436,816 (Spurgeon et al.). The production tool may also contain a release coating to permit easier release of the abrasive composites from the production tool, such as silicones and fluorochemicals, as disclosed in U.S. Pat. No. 5,436,816 (Spurgeon et al.).

EXAMPLES

The following nonlimiting examples will further illustrate the invention. All parties, percentages, ratios, etc., are by weight unless otherwise specified. The following designations are used throughout the examples.

WAO white fused aluminum oxide abrasive grain, commercially available under the trade designation BZK-B from H.C. Stark Co., Laurenberg, Germany;

MSCA gamma-methacryloxypropyltrimethoxysilane, known under the trade designation A-174, commercially available from OSi Specialties, Inc., Danbury, Conn.;

$KBF_4$ potassium tetrafluoroborate, commercially available from Atoteeh USA, Inc., Cleveland, Ohio;

ASP amorphous silica particles having an average surface area of 50 $m^2/g$, and average particle size of 40 millimicrometers, commercially available under the trade designation OX-50 from Degussa Corp., Ridgefield Park, N.J.;

TATHEIC triacrylate of tris(hydroxy ethyl) isocyanurate, commercially available under the trade designation SARTOMER 368 from Sartomer, Exton, Pa.;

TMPTA trimethyolpropane triacrylate, commercially available under the trade designation SARTOMER 351 from Sartomer, Exton, Pa.;

PH2 2-benzyl-2-N,N-dimethylamino-1-(4-morpholinophenyl)-1-butanone, commercially available under the trade designation IRGACURE 369 from Ciba-Geigy Corp., Hawthorne, N.Y.;

BTR Brown aluminum oxide abrasive particles, commercially available from USEM, U.S. Electrofused Mineral, Inc., Baltimore, Md.; and GW Green silicon carbide abrasive particles, commercially available under the trade designation GARB GW from Exolon-ESK Company, Tonawanda, N.Y.

General Procedure for Making Structured Abrasive Articles

The abrasive articles employing slurries of the invention were made generally in accordance with U.S. Pat. No. 5,435,816 (Spurgeon et al.), with the addition of a tie coat precursor. First, a tie coat precursor was applied to the front surface of the cloth backing. Then, an abrasive slurry composition was prepared by thoroughly mixing abrasive particles with a binder precursor consisting of 39.55% TMPTA, 16.95% TATHEIC, 0.56% PH2, 1.98% ASP, 1.98% MSCA, and 38.98% $KBF_4$. The slurry used in each case was coated onto a polypropylene production tool with a 0.036 cm high vari-pitch pattern having a pyramidal type pattern such that the slurry filled the tool. The pyramids were placed such that their bases were butted up against one another. The width of the pyramid base was about 530 micrometers and the pyramid height was about 353 micrometers. This pattern is illustrated in FIG. 1 of PCT Application No. WO 95/07797 (Hoopman).

Next, the tie coated-cloth was pressed against the production tool by means of a nip roll so that the slurry wetted the front surface (i.e., the tie-coated surface) of the cloth. Ultraviolet/visible light was concurrently transmitted through the polypropylene tool and into the abrasive slurry containing the binder precursor. The ultraviolet/visible light initiated the polymerization of the radiation curable resin of the binder precursor, resulting in the abrasive slurry being transformed into an abrasive composite, with the abrasive composite being adhered to the cloth backing. The ultraviolet/visible light sources used were two bulbs known under the trade designation Fusion Systems D bulbs, which operated at 236 watts/cm of bulb width. Finally, the cloth/abrasive composite was separated from the polypropylene production tool, providing a coated abrasive article.

Test Procedures

The following test procedures were used to test structured abrasive articles made according to the examples.

90° Peel Test

In order to measure the degree of adhesion of the structured abrasive layer to the backing, the sheet to be tested was converted into a sample about 8 cm wide by 25 cm long. One-half the length of a wooden board (17.78 cm by 7.62 cm by 0.64 cm thick) was coated with an adhesive. The entire width of, but only the first 15 cm of the length of, the coated abrasive sample was coated with an adhesive on the side bearing the abrasive material. The adhesive was 3M Jet Melt Adhesive #3779, which is commercially available from 3M Company, St. Paul, Minn., applied with a Polygun II. Then, the side of the sample beating the abrasive material was attached to the side of the board containing the adhesive coating in such a manner that the 10 cm of the abrasive sample not bearing the adhesive overhung from the board. Pressure was applied such that the board and the sample were intimately bonded, and sufficient time was allowed for the adhesive to cool and solidify.

Next, the sample to be tested was scored along a straight line such that the width of the coated abrasive test specimen was reduced to 5.1 cm. The resulting abrasive sample/board composite was mounted horizontally in a fixture attached to the upper jaw of a tensile testing machine having the trade designation SINTECH, and approximately 1 cm of the overhanging portion of the abrasive sample was mounted into the lower jaw of the machine such that the distance between jaws was 12.7 cm. The machine separated the jaws at a rate of 0.5 cm/second, with the coated abrasive sample being pulled at an angle of 90° away from the wooden board so that a portion of the sample separated from the board. Separation occurred between layers of the abrasive construction. The machine charted the force per centimeter of specimen width required for separation. The higher the required force, the better the shelling resistance of the abrasive construction.

Some of the articles of the examples were tested for 90° peel adhesion. The force required for separation was expressed in kg/cm. The results are set forth in Tables 1–7, and are presented as an average of two test specimens. It is preferred that the force value be at least 1.8 kg/cm, more preferably at least 2 kg/cm, because inadequate adhesion and weakness at the structured abrasive layer-cloth interface will generally results in inferior performance particularly under dynamic conditions.

Rocker Drum Test

Unflexed structured abrasive articles were converted into 10.2 cm by 15.2 cm sheets. These samples were installed on a cylindrical steel drum of a testing machine which oscillates (rocks) back and forth in a small are creating a 1.3 cm by 10.1 cm wear path. The structured abrasive abraded the stationary 1.3 cm by 1.3 cm by 15.2 cm Type 1018 carbon steel workpiece. There were approximately 60 strokes per minute on this wear path. The load applied to the workpiece via a lever arm was 3.6 Kg. The total amount of carbon steel removed after 500 cycles (i.e., one cycle being one back-and-forth motion) was recorded as the total cut. The results are reported in the tables below as an average of four test specimens. This is referred to herein as a Rocker Drum Test.

EXAMPLES

Structured abrasive articles were made using either Type J or Type X backings. Type J backing was a cellulosic cloth backing having a blend of an acrylic latex/resole phenolic resin (85 parts acrylic latex and 15 parts phenolic) presize. Type X backing was a poly/cotton Colend of polyester and cotton) cloth backing having a blend of an acrylic latex/resole phenolic resin (85 parts acrylic latex and 15 parts phenolic) presize, and a nitrile latex/resole phenolic resin (40 parts latex and 60 parts phenolic) backfill.

Examples 1–4

For the data listed in Table 1, the tie Coat precursor (No. 1) was a 70/30/1 blend of TMPTA, TATHEIC, and PH2 resin coated by a 3 roll squeeze method. It was at least partially cured using an ultraviolet/visible light source of one bulb under the trade designation Fusion System D Bulb operated at 157 watts/cm of bulb width, and a line speed of 45.7 meters/minute. The abrasive slurry (No. 1) included 58.9% Fade: P-320 WAO and 41.1% binder precursor as described above in the General Procedure for Making Structured Abrasive Articles.

TABLE 1

| Backing | Example No. | Line Speed (meters/minute) | Abrasive Slurry No. | Tie Coat Precursor No. | Adhesion Force (Kg/cm) |
|---|---|---|---|---|---|
| Type J | 1 | 30.5 | 1 | 1 | 2.47 |
| Type J | 2 | 30.5 | 1 | 1 | 2.49 |
| Type J | 3 | 30.5 | 1 | 1 | 2.34 |
| Type J | 4 | 30.5 | 1 | none | 1.65 |

This data shows the reproducibility of three individual rolls coated with the tie coat and processed as discussed above. It also signifies the significant improvement in adhesion with the use of the tie coat.

Examples 5–13

For the data listed in Table 2, the tie coat precursor (No. 2) was 70/30/1 blend of TMPTA, TATHEIC, and PH2 resin coated in-line with a knife over bed method using a 0.003 cm gap onto the backing. The tie coat precursor was not precured before the abrasive slurry was applied and cured. The tie coat precursor (No. 3) was 70/30/1 blend of TMPTA, TATHEIC, and PH2 resin coated in-line with a knife over web method using a 0.003 cm gap onto the backing. The tie coat precursor was not precured before the abrasive slurry was applied and the binder precursor contained therein was at least partially cured.

TABLE 2

| Backing | Ex. No. | Line Speed (meters/minute) | Abrasive Slurry No. | Tie Coat Precursor No. | Adhesion Force (Kg/cm) | Rocker Drum Cut (grams) |
|---|---|---|---|---|---|---|
| Type J | 5 | 15.2 | 1 | 2 | 2.19 | nt[1] |
| Type J | 6 | 22.9 | 1 | 2 | 2.10 | 0.27 |
| Type J | 7 | 30.5 | 1 | 2 | 2.01 | 0.27 |
| Type J | 8 | 15.2 | 1 | 3 | 2.25 | nt |
| Type J | 9 | 30.5 | 1 | 3 | 1.77 | 0.34 |
| Type J | 10 | 45.7 | 1 | 3 | 1.51 | nt |
| Type J | 11 | 15.2 | 1 | none | 1.48 | nt |
| Type J | 12 | 30.5 | 1 | none | 1.65 | nt |
| Type J | 13 | 45.7 | 1 | none | 1.08–1.61[2] | 0.28 ± 0.03[2] |

[1]nt = not tested.
[2]This represents a number of tests, therefore a range is presented.

This data indicates that having back-up support, provided by the knife over bed coating method, when the tie coat precursor is applied is beneficial in maintaining high adhesion values as run speed is increased. It also demonstrates that the tie coat precursor does not need to be cured prior to application of the abrasive slurry.

Examples 14–17

For the data in Table 3, the abrasive slurry (No. 2) included 49% binder precursor and 51% GW grade F-400, the slurry (No. 3) included 46% binder precursor and 54% GW grade F180. The tie coat (No. 4) was coated with the 3 roll squeeze method and 50/50/1 TMPTA, TATHEIC, and PH2 resin.

TABLE 3

| Backing | Ex. No. | Line Speed (meters/minute) | Abrasive Slurry No. | Tie Coat Precursor No. | Adhesion Force (Kg/cm) | Rocker Drum Cut (grams) |
|---|---|---|---|---|---|---|
| Type J | 14 | 15.2 | 2 | none | 0.67 | 0.08 |
| Type J | 15 | 15.2 | 2 | 4 | 1.04 | 0.08 |
| Type J | 16 | 15.2 | 3 | none | 0.79 | 0.30 |
| Type J | 17 | 22.8 | 3 | 4 | 1.56 | 0.31 |

For structured abrasive constructions using GW, the minimum acceptable adhesion force for most applications is 0.90 Kg/cm. Use of the tie coat results in acceptable adhesion values at these line speeds.

Examples 18–29

For the data in Table 4, the abrasive slurries (No. 4) included 40.8% binder precursor and 59.2% grade F180 BTR, (No. 5) included 42.62% binder precursor and 57.38% grade F240 BTR, (No. 6) included 43% binder precusor and 57% grade F220 BTR, and (No. 7) included 48% binder precursor and 52% grade F360 BTR. The tie coat precursors (Nos. 1 and 4) were coated as described above.

TABLE 4

| Backing | Ex. No. | Line Speed (meters/minute) | Abrasive Slurry No. | Tie Coat Precursor No. | Adhesion Force (Kg/cm) | Rocker Drum Cut (grams) |
|---|---|---|---|---|---|---|
| Type J | 18 | 30.5 | 4 | none | 1.22 | 0.24 |
| Type J | 20 | 30.5 | 4 | 1 | 2.01 | 0.36 |
| Type J | 19 | 45.7 | 4 | 1 | 1.99 | 0.38 |
| Type J | 21 | 76.2 | 4 | 4 | 1.79 | 0.33 |
| Type J | 22 | 30.5 | 5 | none | 1.54 | 0.26 |
| Type J | 23 | 30.5 | 5 | 4 | 2.19 | nt[1] |
| Type J | 24 | 45.7 | 5 | 4 | 2.06 | nt |
| Type J | 25 | 30.5 | 6 | none | 1.51 | 0.34 |
| Type J | 26 | 45.7 | 6 | none | 1.24 | nt |
| Type X | 27 | 30.5 | 7 | none | 1.78 | 0.08 |
| Type X | 28 | 30.5 | 7 | 4 | 2.05 | 0.09 |
| Type X | 29 | 45.7 | 7 | 4 | 2.12 | 0.09 |

[1]nt = Not tested.

This data shows that the tie coat improves adhesion over a broad range of mineral sizes and line speeds. To verify these tests, belts were tested in an actual customer-type application involving the grinding of titanium-based golf clubs. Examples 23 and 24 with fie coat showed 25% improvement in the number of parts ground and ran more evenly from start to finish compared to Example 22 belts that did not have the tie coat for grinding the shaped portions of titanium-based golf clubs. The belts from Examples 23 and 24 had much less shelling of the abrasive from the backing compared to Example 22 belt, which indicates that the adhesion of the structured abrasive layer to the backing is improved during actual use of the belt. This substantial improvement in grinding performance and life was an unexpected result of having the tie coat in the construction.

Examples 30–41

For the data listed in Table 5, the tie coat precursors and abrasive slurries are as listed above. Certain of the samples were post cured at 116° C. for 12 hours.

TABLE 5

| Backing | Ex. No. | Line Speed (meters/minute) | Abrasive Slurry No. | Tie Coat Precursor No. | Adhesion Force (Kg/cm) | Post Cured |
|---|---|---|---|---|---|---|
| Type X | 30 | 45.7 | 5 | 4 | 2.75 | yes |
| Type X | 31 | 45.7 | 5 | 4 | 2.7 | no |
| Type J | 32 | 45.7 | 5 | 4 | 2.5 | yes |
| Type J | 33 | 45.7 | 5 | 4 | 2.29 | no |
| Type J | 34 | 15.2 | 5 | 1 | 2.56 | yes |
| Type J | 35 | 15.2 | 5 | 1 | 2.44 | no |
| Type J | 36 | 30.5 | 5 | 1 | 2.37 | yes |
| Type J | 37 | 30.5 | 5 | 1 | 2.41 | no |
| Type J | 38 | 45.7 | 5 | 1 | 2.28 | yes |
| Type J | 39 | 45.7 | 5 | 1 | 2.11 | no |
| Type J | 40 | 61 | 5 | 1 | 1.75 | yes |
| Type J | 41 | 61 | 5 | 1 | 1.34 | no |

The data in Table 5 shows that thermal post-curing generally has little effect on adhesion, although thermal posi-cure is desirable for curing the backfill coating, which was on the Type X cloth backing only.

Examples 42–54

For the data listed in Table 6, the tie coat precursor (No. 5) was the same as tie coat precursor (No. 1) except only 0.16 part of PH2 was used. Tie coat precursor (No. 6) was the same as tie coat precursor (No. 1) except only 0.25 part of PH2 was used. Tie coat precursor (No. 7) was the same as tie coat precursor (No. 1) except only 0.5 part of PH2 was used. Tie coat precursor (No. 8) was the same as tie coat precursor (No. 1) except only 0.75 part of PH2 was used. All were coated and cured in the same manner as was tie coat precursor (No. 1).

Examples 42–54 were prepared by coating the tie coat precursor onto the backing (3.14 cm by 4.72 cm) using a number 24 wire wound rod to spread a uniform layer of treatment resin over the backing. The coated backing was cured by taping the sample to a metal tray and passing under a Fusion D bulb at 236 watts/cm at the listed line speed and environmental condition. The treated samples were coated with the structured abrasive slurry with the same method as in Example 1 with the following change. The cloth samples, 3.14 cm by 4.72 cm were taped to a 0.008 cm polyethylene terephthalate (PET) film that was 3.94 cm wide and the line was run at 15.2 meters/minute.

TABLE 6

| Backing | Ex. No. | Tie Coat Treatment | Tie Coat Cure Environ't | Tie Coat Cure Speed (meters/minute) | Slurry No. | Adhesion Force (Kg/cm) |
|---|---|---|---|---|---|---|
| Type J | 42 | 4 | air | 30.5 | 5 | 2.01 |
| Type J | 43 | 4 | nitrogen | 30.5 | 5 | 1.99 |
| Type J | 44 | 4 | air | 61 | 5 | 1.97 |
| Type J | 45 | 4 | nitrogen | 61 | 5 | 2.01 |
| Type J | 46 | 1 | air | 30.5 | 5 | 1.94 |
| Type J | 47 | 1 | nitrogen | 30.5 | 5 | 2.02 |
| Type J | 48 | 1 | air | 61 | 5 | 1.83 |
| Type J | 49 | 1 | nitrogen | 61 | 5 | 2.01 |
| Type J | 50 | none | — | — | 5 | 1.66 |
| Type J | 51 | 5 | air | 30.5 | 5 | 1.74 |
| Type J | 52 | 6 | air | 30.5 | 5 | 1.88 |
| Type J | 53 | 7 | air | 30.5 | 5 | 1.97 |
| Type J | 54 | 8 | air | 30.5 | 5 | 2.02 |

These results indicate that the adhesion force of the cured structure abrasive slurry to the backing indicates that the run speed studied and the environment under which the tie coat was cured did not effect the resulting adhesion. The photo-initiator concentration used to cure the tie coat to the backing has an effect on the adhesion of the structured abrasive to the backing being best at concentrations above 0.25 part of the resin system studied.

Examples 55–56

For the data listed in Table 7, no treatment coat(s) (e.g., presize or backfill coats) were used on the cloth backings. The tie coat precursor (No. 4) and the abrasive slurry (No. 1) are described above.

TABLE 7

| Backing | Ex. No. | Tie Coat | Line Speed (meters/minute) | Slurry No. | Adhesion Force (Kg/cm) |
|---|---|---|---|---|---|
| Type X (untreated) | 55 | none | 15.9 | 1 | <0.36 |
| Type X (untreated) | 56 | 4 | 15.9 | 1 | 1.47 |

This example shows that a tie coat produces enhanced adhesion values, even when no cloth treatment is present.

Various modifications and alterations of this invention will become apparent to those skilled in the art without departing from the scope and principles of this invention. It should be understood that this invention is not to be unduly limited to the illustrative embodiments set forth hereinabove. All publications and patents are herein incorporated by reference to the same extent as if each individual publication or patent was specifically and individually indicated to be incorporated by reference.

What is claimed is:

1. A method of preparing an abrasive article, the method comprising:

(a) providing a backing having a first major surface;

(b) coating the first major surface of the backing with a tie coat precursor, wherein the fie coat precursor comprises a first radiation curable component;

(c) applying an abrasive slurry to the first major surface of the backing after coating the fie coat precursor thereon, wherein the abrasive slurry comprises a plurality of abrasive particles and a binder precursor, and further wherein the binder precursor comprises a second radiation curable component;

(d) at least partially curing the tie coat precursor; and (e) at least partially curing the binder precursor to form an abrasive article.

2. The method of claim 1 wherein the step of at least partially curing the tie coat precursor occurs prior to the step of applying an abrasive slurry to the first major surface of the backing.

3. The method of claim 2 wherein the step of at least partially curing the tie coat precursor comprises exposing the tie coat precursor to radiation energy.

4. The method of claim 3 wherein the radiation energy comprises ultraviolet radiation, visible radiation, E-beam radiation, or combinations thereof.

5. The method of claim 1 wherein the steps of at least partially curing the tie coat precursor and at least partially curing the binder precursor occur substantially simultaneously.

6. The method of claim 5 wherein the steps of at least partially curing the tie coat precursor and at least partially curing the binder precursor comprise exposing both the tie coat precursor and binder precursor to radiation energy.

7. The method of claim 6 wherein the radiation energy comprises ultraviolet radiation, visible radiation, E-beam radiation, or combinations thereof.

8. The method of claim 1 wherein the backing comprises a treated cloth.

9. The method of claim 1 wherein:

(a) the step of applying the abrasive slurry to the backing comprises:

(i) providing a production tool having a contacting surface;

(ii) applying the abrasive slurry onto the contacting surface of the production tool; and (iii) causing the abrasive slurry on the contacting surface of the production tool to come into contact with the first major surface of the backing; and (b) the step of at least partially curing the binder precursor to form an abrasive article comprises:

(i) at least partially curing the binder precursor to form a shaped, handleable structure; and (ii) separating the shaped, handleable structure from the production tool to form an abrasive article.

10. The method of claim 9 which is a continuous process.

11. The method of claim 10 wherein the continuous process is carried out at a line speed of at least about 25 meters/minute.

12. The method of claim 1 wherein the first radiation curable component is an acrylate-functional compound.

13. The method of claim 12 wherein the tie coat precursor comprises an acrylate monomer and an isocyanurate derivative having at least one pendant acrylate group.

14. The method of claim 1 wherein the second radiation curable component is an acrylate-functional compound.

15. The method of claim 14 wherein the binder precursor comprises an acrylate monomer and an isocyanurate derivative having at least one pendant acrylate group.

16. The method of claim 15 wherein the fie coat precursor comprises an acrylate monomer and an isocyanurate derivative having at least one pendant acrylate group.

17. The method of claim 16 wherein the tie coat precursor and binder precursor each further comprise a photoinitiator.

18. An abrasive article made by the method of claim 1.

19. An abrasive article made by the method of claim 9.

20. An abrasive article made by the method of claim 17.

21. A method of preparing an abrasive article, the method comprising:

(a) providing a treated cloth backing having a first major surface;

(b) coating the first major surface of the treated cloth backing with a tie coat precursor, wherein the tie coat precursor comprises a first radiation curable component;

(c) providing a radiation energy transmissive production tool having a contacting surface;

(d) applying an abrasive slurry onto the contacting surface of the production tool, wherein the abrasive slurry comprises a plurality of abrasive particles and a binder precursor, and further wherein the binder precursor comprises a second radiation curable component;

(e) causing the abrasive slurry on the contacting surface of the production tool to come into contact with the first major surface of the backing after coating the tie coat precursor thereon;

(f) at least partially curing the tie coat precursor;

(g) transmitting radiation energy through the production tool to at least partially cure the binder precursor to form a shaped, handleable structure; and (h) separating the shaped, handleable structure from the production tool to form an abrasive article.

22. The method of claim 21 wherein the step of at least partially curing the tie coat precursor is carried out prior to the step of causing the abrasive slurry on the contacting surface of the production tool to come into contact with the first major surface of the backing.

23. The method of claim 22 wherein the step of at least partially curing the tie coat precursor comprises exposing the tie coat precursor to radiation energy.

24. The method of claim 21 wherein the step of at least partially curing the tie coat precursor occurs when the step of transmitting energy through the production tool to at least partially cure the binder precursor is carried out.

25. The method of claim 24 which is a continuous process carried out at a line speed of at least about 25 meters/minute.

26. An abrasive article comprising:

(a) a cloth backing having a first major surface;

(b) a radiation cured tie coat on the first major surface of the backing; and (c) an abrasive layer on the radiation cured tie coat, wherein the abrasive layer comprises a plurality of abrasive particles dispersed in a radiation cured binder.

27. The article of claim 26 wherein the cloth backing comprises a treated cloth backing.

28. The article of claim 26 which is a structured abrasive article.

29. The article of claim 26 wherein the radiation cured tie coat is prepared from a tie coat precursor comprising an acrylate monomer and an isocyanurate derivative having at least one pendant acrylate group.

30. The article of claim 26 wherein the radiation cured binder is prepared from a binder precursor comprising an acrylate monomer and an isocyanurate derivative having at least one pendant acrylate group.

* * * * *

UNITED STATES PATENT AND TRADEMARK OFFICE

CERTIFICATE OF CORRECTION

PATENT NO. : 5,700,302
DATED : December 23, 1997
INVENTOR(S) : William L. Stoetzel and Scott R. Culler It is certified that error appears in the above-identified patent and that said Letters Patent is hereby corrected as shown below:

Column 5,
Line 3, "from" should read -- front --
Line 37, "polyarnide" should read -- polyamide --
Line 42, "ting" should read -- ring --

Column 6,
Line 32, "tatices" should read -- latices --
Line 64, "crossing" should read -- crosslinking --

Column 11,
Line 44, "mires" should read -- articles --

Column 12,
Line 33, "5,0,51,294" should read -- 5,061,294 --
Line 59, "fie" should read -- tie --

Column 13,
Line 56, "fie" should read -- tie --

Column 14,
Line 47, "ring" should read -- turning --
Line 48, "5,436,816" should read -- 5,435,816 --
Line 52, "5,436,816" should read -- 5,435,816 --
Line 57, "parties" should read -- parts --

Column 16,
Line 3, "beating" should read -- bearing --
Line 56, "Colend" should read -- (blend --
Line 64, "Coat" should read -- coat --

Column 17,
Line 4, "Fade:" should read -- grade --

UNITED STATES PATENT AND TRADEMARK OFFICE

CERTIFICATE OF CORRECTION

PATENT NO. : 5,700,302
DATED : December 23, 1997
INVENTOR(S) : William L. Stoetzel and Scott R. Culler It is certified that error appears in the above-identified patent and that said Letters Patent is hereby corrected as shown below:

Column 18,
Table 4, under Ex. No. "20" should read -- 19 --
Table 4, under Ex. No. "19" should read -- 20 --
Line 51, "fie" should read -- tie --

Column 19,
Line 21, "posi-cure" should read -- post-cure --

Column 20,
Line 40, "fie" should read -- tie --
Line 43, "fie" should read -- tie --

Signed and Sealed this

Twenty-sixth Day of March, 2002

*Attest:*

*Attesting Officer*

JAMES E. ROGAN
*Director of the United States Patent and Trademark Office*